US005551615A

United States Patent [19]

McIntosh

[11] Patent Number: 5,551,615

[45] Date of Patent: Sep. 3, 1996

[54] NECK HARNESS

[76] Inventor: Raymond F. McIntosh, 956 Shearers Rd., Mooresville, N.C. 28115

[21] Appl. No.: 452,811

[22] Filed: May 30, 1995

[51] Int. Cl.[6] ..... A45F 5/00

[52] U.S. Cl. ..... 224/270; 224/250; 224/257; 224/258; 224/600; 224/607; 224/608; 224/610; 224/623; 224/930

[58] Field of Search ..... 224/250, 257, 224/258, 270, 242, 246, 600, 607, 608, 610, 611, 612, 619, 623, 648, 902, 908, 929, 930

[56] References Cited

U.S. PATENT DOCUMENTS

| | | | |
|---|---|---|---|
| 1,089,569 | 3/1914 | MacKinnon . | |
| 1,232,089 | 7/1917 | Riebe | 224/258 |
| 2,387,232 | 10/1945 | Brede . | |
| 2,586,954 | 2/1952 | Juliano | 224/908 |
| 2,952,200 | 9/1960 | Welch . | |
| 3,021,744 | 2/1962 | Kester | 224/265 |
| 3,541,976 | 11/1970 | Rozas | 224/625 |
| 4,347,956 | 9/1982 | Berger . | |
| 4,537,340 | 8/1985 | Waltzer . | |
| 4,915,278 | 4/1990 | Smith . | |
| 5,062,558 | 11/1991 | Stang | 224/270 |
| 5,186,375 | 2/1993 | Plonk . | |

FOREIGN PATENT DOCUMENTS

| | | | |
|---|---|---|---|
| 424589 | 1/1912 | France | 224/270 |

*Primary Examiner*—Henry J. Recla
*Assistant Examiner*—Kam Shah
*Attorney, Agent, or Firm*—Shefte, Pinckney & Sawyer

[57] ABSTRACT

A single strap-support neck harness for suspending a scanner or other electronic device from a user's neck includes a housing for receiving a scanner to be suspended, a rigid brace arrangement, and an elongated flaccid neck strap. The rigid brace arrangement comprises two rigid V-shaped angular support members, with each support member attaching to opposite sides of the housing and having converging portions projecting upwardly from the housing. Ends of the strap attach to the separate ends of the projecting converging portions of the support members and, when worn about the neck, the strap suspends the brace arrangement and housing oriented with one end of the housing engaging the user's torso to extend the scanner to face the user at an upward incline from the user's torso for easy viewability of the scanner. Furthermore, the support members are angled so that a gravitational torque tends to force one end of the housing upward and into the torso of the user for stabilized suspension of the housing during movement by the user.

13 Claims, 5 Drawing Sheets

NECK HARNESS

BACKGROUND OF THE INVENTION

The present invention relates to a neck harness for suspending an object from a users neck and, more particularly, to an improved single strap-support neck harness for receiving, e.g., a scanner or other electronic device for use in listening to radio transmissions at racing events.

Generally, prior art neck harnesses comprise a framework supported by a flaccid neck strap that are designed to allow electronic equipment to be suspended from a user's neck. For example, Waltzer, U.S. Pat. No. 4,537,340, discloses a harness for a radio control module associated with a radio controlled model aircraft. The harness has an adjustable flaccid neck strap for supporting a bracket for receiving the radio control module. A brace member of the bracket is held in place against the abdomen by the palms of the user. The two ends of the strap are attached to the bracket at spaced attachment pins on the brace member. An additional feature includes auxiliary straps extending from the neck strap to a round eyelet on the bracket spaced from the brace member. This additional strap supports the bracket from tilting, and to some extent, lessens the role of the hands.

In another prior art patent, Plonk, U.S. Pat. No. 5,186,375, a harness is disclosed for computers used by utility meter readers. The harness has a flaccid neck strap attached to a rectangular bracket for receiving a computer. The neck strap is shown fastened to opposite diagonal corners of the bracket, and alternatively, can be fastened to any two of the four corners. Plonk also discloses a plate that depends from the rear edge of the bracket and that is inserted into the waistband of the trousers of a user for bracing the bracket against the body. By anchoring the plate to the trousers, the plate supports the bracket and stabilizes it from tilting.

A problem with prior art harnesses that utilize only one supporting neck strap, and that do not utilize further support means such as auxiliary straps or plates, is the susceptibility of the bracket of the harness to slipping away from a user's body or tilting out of its original orientation. Those harnesses that do utilize complicated harness frameworks, like the auxiliary strap in Waltzer and the trouser supporting plate in Plonk, are cumbersome in practice. There thus exists a need for a simple yet effective single strap-support harness that provides against slippage of the bracket away from the body of a user, or tilting out of its orientation.

Furthermore, there exists a need for a harness that is stable when a user is in both a sitting position and a standing position, and all positions therebetween. The prior art harnesses discussed above are disclosed as practiced in a standing position, and would be cumbersome or ineffective when used in a sitting position and in changing between sitting and standing positions. For example, the harness disclosed in Waltzer would be disrupted by a user's thighs in a sitting position and any support of the harness by the thighs would cause the auxiliary strap to become limp. Suddenly arising to a standing position would consequently cause the harness to undergo a quick snapping motion that could dislodge a contained object within the harness, thereby throwing it to the ground; as the support of the legs falls away, the front of the bracket rotates downward about the bracing member until the auxiliary strap suddenly becomes taut, thereby producing a sudden jar.

This need for a stable harness arises especially in the case where fans in the grandstands scan radio transmissions of racing teams at racing events. It is common for fans to program scanners so that car 43, for example, will be scanned on channel 43 of the scanner, and so on. Then, when at racing events, fans can monitor their scanners for radio transmissions between the pit crews and race car drivers. Since a scanner typically displays the current channel being scanned, when a transmission is received by the scanner a fan need only glance at the scanner to determine which team is making the broadcast, with channel 43 corresponds with car 43, etc. Seating at such events is very close and tight, however, and it is often undesirable to simply hold a scanner in hand and watch the race, especially if one desires to consume beverages and concessions. There literally is no room between spectators for resting scanners when wishing to free use of the hands.

To alleviate this problem, some fans have attempted the use of a strap for attaching scanners to their thighs for hands-free monitoring. This strap is adequate when fans are in a sitting position because they need only glance down at their thigh to view the channel, and hence racing team, being scanned. However, often people stand when there is an occurrence such as a crash in the race, and those with scanners must bend over to read their scanners when standing. The situation is even more problematic in practice because there is usually a great amount of radio transmissions when an occurrence such as a crash happens. Furthermore, if the scanner is not securely fastened, then when a fan rapidly stands a strapped scanner may dislodge and fall to the ground.

There thus is a special need for a single strap-support neck harness that provides easy viewing of a scanner or other electronic device when monitoring radio transmissions at racing events. Furthermore, not only must the neck harness provide convenient and easy viewing of the scanner channel being scanned, but it must also provide stability when a fan rapidly rises for an event and then returns to his seat. The harness should also be unencumbersome and function without requiring use of the hands, auxiliary support straps, or support plates.

SUMMARY OF THE INVENTION

The present invention relates to a neck harness for suspending an object around a user's neck, and more specifically, to an improved single strap-support neck harness for suspending a scanner about a user's neck for convenient monitoring of radio transmissions of race teams at racing events. Furthermore, the harness functions hands-free and is stable in a sitting position, standing position, and all positions therebetween. The present invention comprises a housing for receiving a scanner to be suspended, a rigid brace arrangement, and an elongated flaccid neck strap. The housing comprises a channel accommodating the insertion of a scanner for facing outwardly from the channel for viewing of the scanner. The rigid brace arrangement comprises two rigid angular support members, with each support member respectively attached to the housing at opposite sides of the channel, and with each support member having converging portions projecting outwardly from the housing forwardly of the channel. The elongated flaccid neck strap is attached at opposite ends to separate support members at attachment points in order to suspend hands-free the scanner from the user's neck with one end of the housing engaging the user's torso to extend the scanner to face the user at an upward incline from the user's torso for easy viewability of the scanner. Specifically, the housing has an engageable end that tends to rotate upward and into the torso of the user for supporting the housing at an upward incline.

A further feature of the harness of the present invention includes means on the flaccid neck strap for adjusting the length of the neck strap for selectively positioning the suspension of the housing and brace arrangement against a user's torso for stable suspension of the scanner substantially unaffected by movement of the user between standing and sitting positions and all transitional positions therebetween.

Another feature of the harness of the present invention includes fasteners disposed on the housing for securely fastening the housing within the channel.

In the preferred embodiment of the present invention, the housing comprises a channel formed by two sides, a back, a lower wall, and an upper lip. The sides of the housing have a length and the upper lip, lower wall, and back have a width, with the length being substantially greater than the width to accommodate the typical shape of a scanner. The upper lip is designed to accommodate an antennae of the scanner as well as any control knobs disposed on the top of the scanner. The channel is of sufficient size to snugly retain the scanner within the housing when suspended about a user's neck.

The rigid brace arrangement preferably comprises two pair of elongated and rigid brace members. Each pair of brace members is attached to separate sides of the housing that form the channel, and each brace member of each pair has two ends with one end securely attached to a side of the housing and the other end projecting away from the housing. Each brace member of each pair of brace members also preferably attaches to the respective sides of the housing at a distance from where the other brace member of the respective pair attaches, with the distance having the same order of magnitude as the distance of the length of the sides of the housing. Each projecting end of a brace member of each pair is securely attached to the other brace member of that pair. The projecting ends of the brace members preferably converge with one another and attach to one another at their projecting ends. Furthermore, each brace member of each pair preferably is disposed towards the other brace member of that pair so that the brace members and the respective side of the housing form inner acute angles. Thus, the brace members are disposed to form angular V-shaped support members, and the points of attachment extend over an area of the housing in-between the ends of the housing.

Furthermore, in the preferred embodiment of the present invention, the angular support members have predetermined angular orientations relative to the housing for disposing the converging portions so that, when the neck harness is suspended from a user's neck, the attachment points are horizontally closer to the user's torso that the center of mass of the housing, rigid brace arrangement, and scanner. This structural feature of the present invention results in a gravitational torque about the attachment points tending to urge the engageable end of the housing upward and into a user's torso for stabilized suspension of the housing at an angle forwardly of the user's torso during movement of the user between standing and sitting positions. In other words, the torque produced by gravity tends to stabilize the orientation of the housing by urging it into the user's torso.

Each end of the neck strap is attached to separate pairs of brace members, with each end attached to at least one projecting end of a pair of brace members. Preferably, each end of the neck strap attaches to separate pairs of brace members at their converging projecting ends.

The harness of the present invention satisfies the needs discussed above due to its unique structure. The housing and the rigid brace arrangement in the present invention cooperate to retain the scanner in an upward angle from a user's torso when the scanner is suspended at such an angle about a user's neck. The lower wall of the housing acts as a floor for the scanner and supports the housing against the torso of the user. The scanner suspends hands-free and provides convenient viewing when the user is standing, sitting, or in-between these two positions.

Furthermore, the torque produced by gravity on the center of mass of the rigid brace arrangement, housing, and scanner causes the upper part of the housing to rotate downward and the lower part of the housing to rotate upward with part of the lower part of the housing, i.e, the engageable end, tending to rotate into a user's torso, thereby blocking rotation of the housing. Preferably, the edge of the lower end of the scanner is urged into the user's torso, as illustrated in FIG. 1. This torquing action stabilizes the harness during standing, sitting, and all positions therebetween, especially when the strap's length is properly adjusted. Thus, the harness of the present invention remains in a stable state upon relative movement between the torso and lower part of the body.

DETAILED DESCRIPTION OF THE PREFERRED EMBODIMENT

Figure 2:
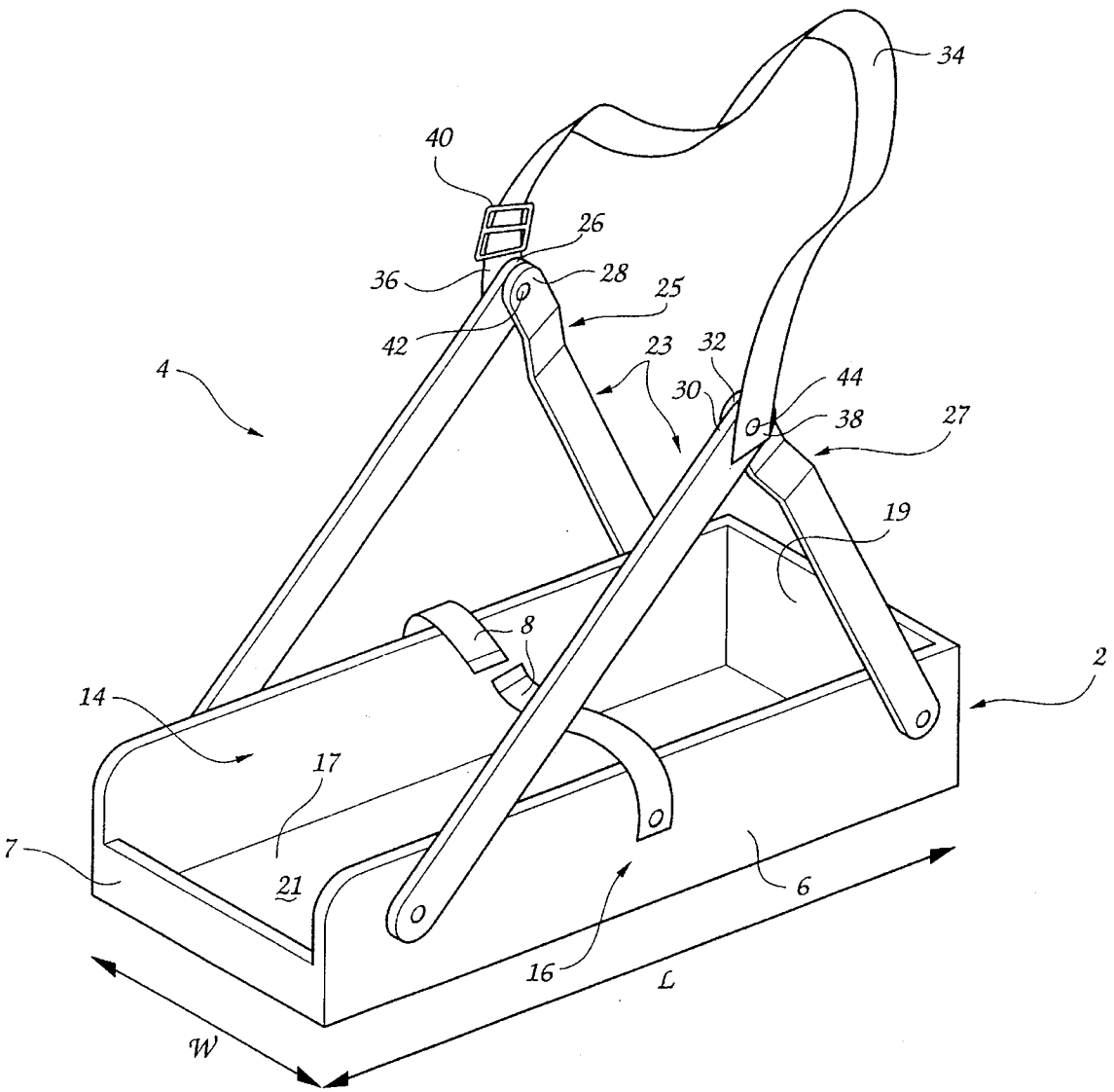
FIG. 2 is a perspective view of the harness of FIG. 1.
Figure 3:
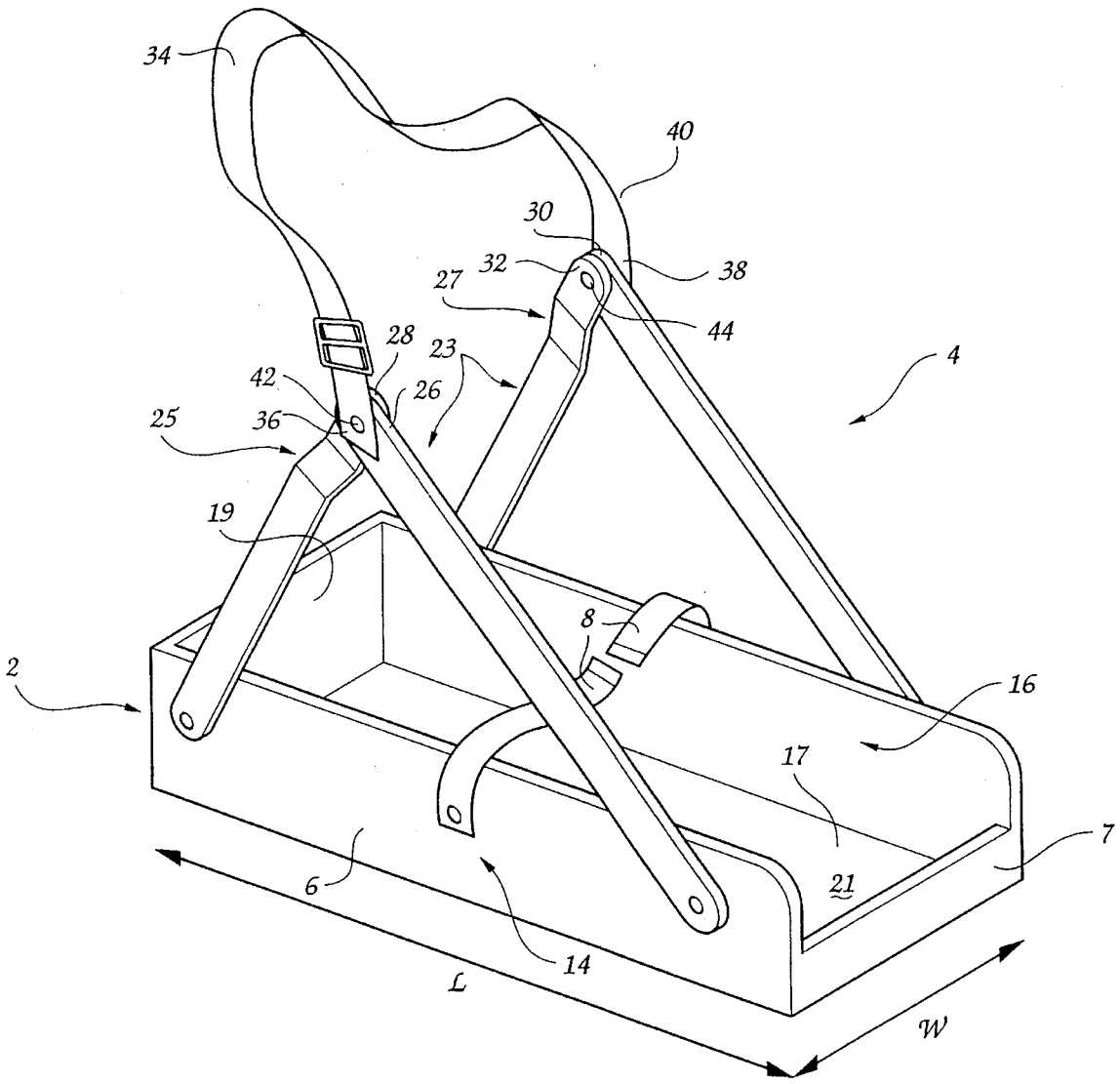
FIG. 3 is another perspective view of the harness of FIG. 1.
Figure 4:
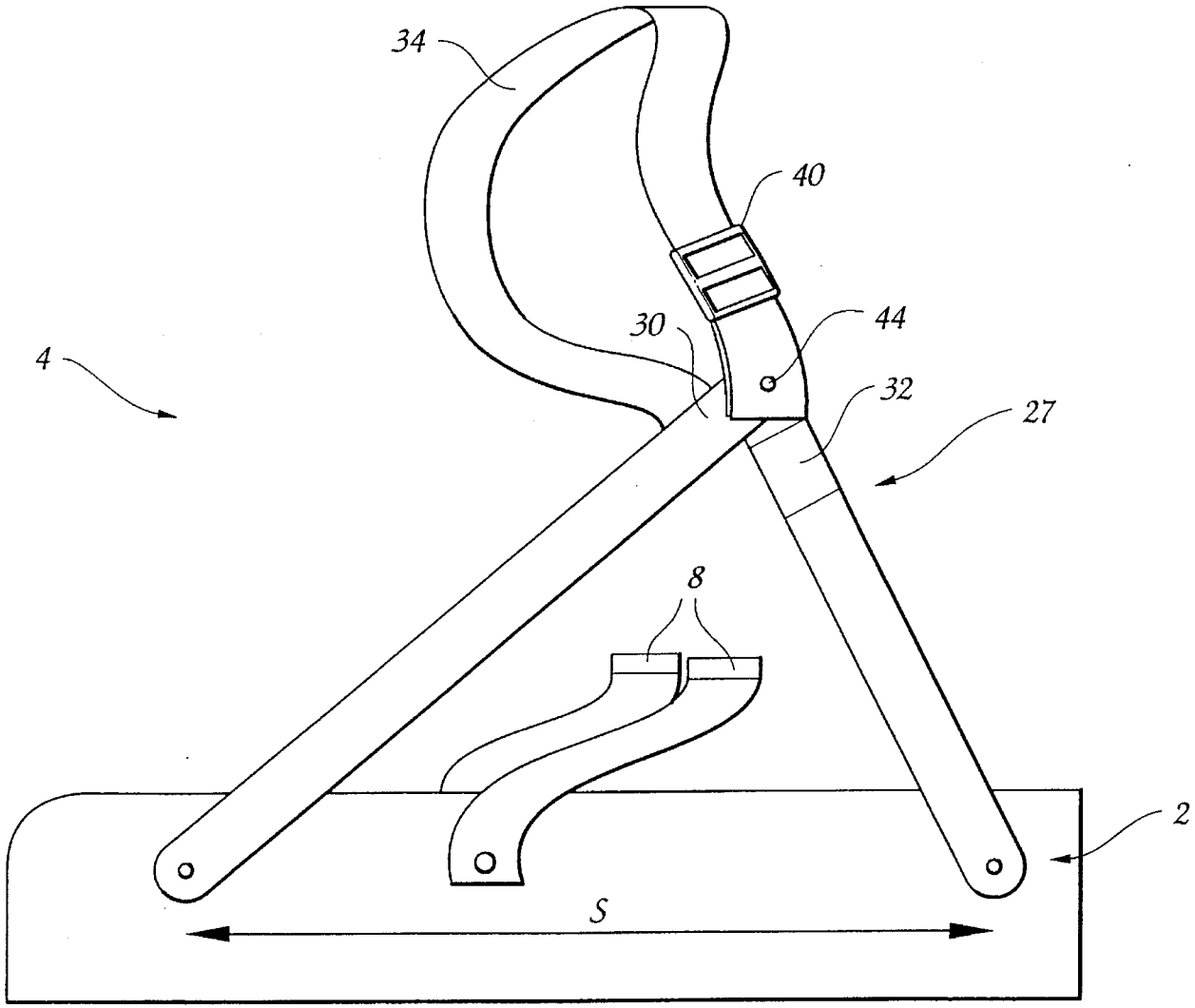
FIG. 4 is a side elevational view of the harness of FIG. 1.

Referring now to the drawings, particularly FIGS. 2–4, the preferred embodiment of the present invention will now be discussed.

The neck harness 4 of the preferred embodiment of the present invention comprises a housing 6 for receiving a scanner or other electronic device to be suspended from a user's neck. The housing 6 is designed to hold a scanner for detecting radio transmissions, and its shape conforms to that of a standard hand-held scanner.

Specifically, housing 6 comprises two sides 14, 16 disposed by a width W. The two sides 14, 16, together with back 17, lower wall 19, and upper lip 7, form channel 21 for receiving a scanner when the housing 6 is suspended about a user's neck. The sides 14, 16 of housing 6 have a length L and the upper lip 7, back 17, and lower wall 19 all have said width W, with L being substantially greater than W to accommodate the standard size of a scanner. Channel 21 also is of sufficient size to snugly retain the scanner within housing 6 when suspended about a user's neck. Upper lip 7 accommodates an antennae of the scanner as well as any control knobs disposed on the top of a scanner. Housing 6 further features fasteners 8 for securely fastening a received scanner within housing 6, with fasteners 8 hooking together by way of conventional hook and loop fasteners.

Rigid brace arrangement 23 comprises two pairs 25,27 of elongated and rigid brace members, with each pair forming a support member. Each pair 25,27 of brace members is respectively attached to separate sides 14, 16 of housing 6 and each brace member of each pair 25,27 has two ends with one end securely attached to a side of housing 6 and the other end projecting away from housing 6. The spacing S illustrated in FIG. 4 between where one brace member and another brace member of a pair 25,27 of brace members attaches to a side of housing 6 is of the same order of magnitude as the distance L of housing 6. Furthermore, each projecting end of the brace members of each pair is securely attached to the other brace member of that pair, and more specifically, projecting ends 26,30 of brace member pairs 25,27 converge with and attach to projecting ends 28,32 of brace member pairs 25,27, respectively, thereby forming V-shaped support members. Each brace member of each pair 25,27 is further disposed towards one another so that the brace members of each pair 25,27 form inner acute angles with sides 14, 16. For instance, referring to FIG. 5, brace members of pair 27 form angles $\Psi,\Theta$ with side 16. Brace members of pair 25 also preferable form angels $\Psi,\Theta$ with side 14 (not shown).

A flaccid neck strap 34 is also included that has ends 36,38 that rotably attach at attachment points 42,44 to the projecting ends 26,28 of pair 25 and projecting ends 30,32 of pair 27, respectively. Buckle 40 is provided for adjusting the length of neck strap 34.

Figure 1:
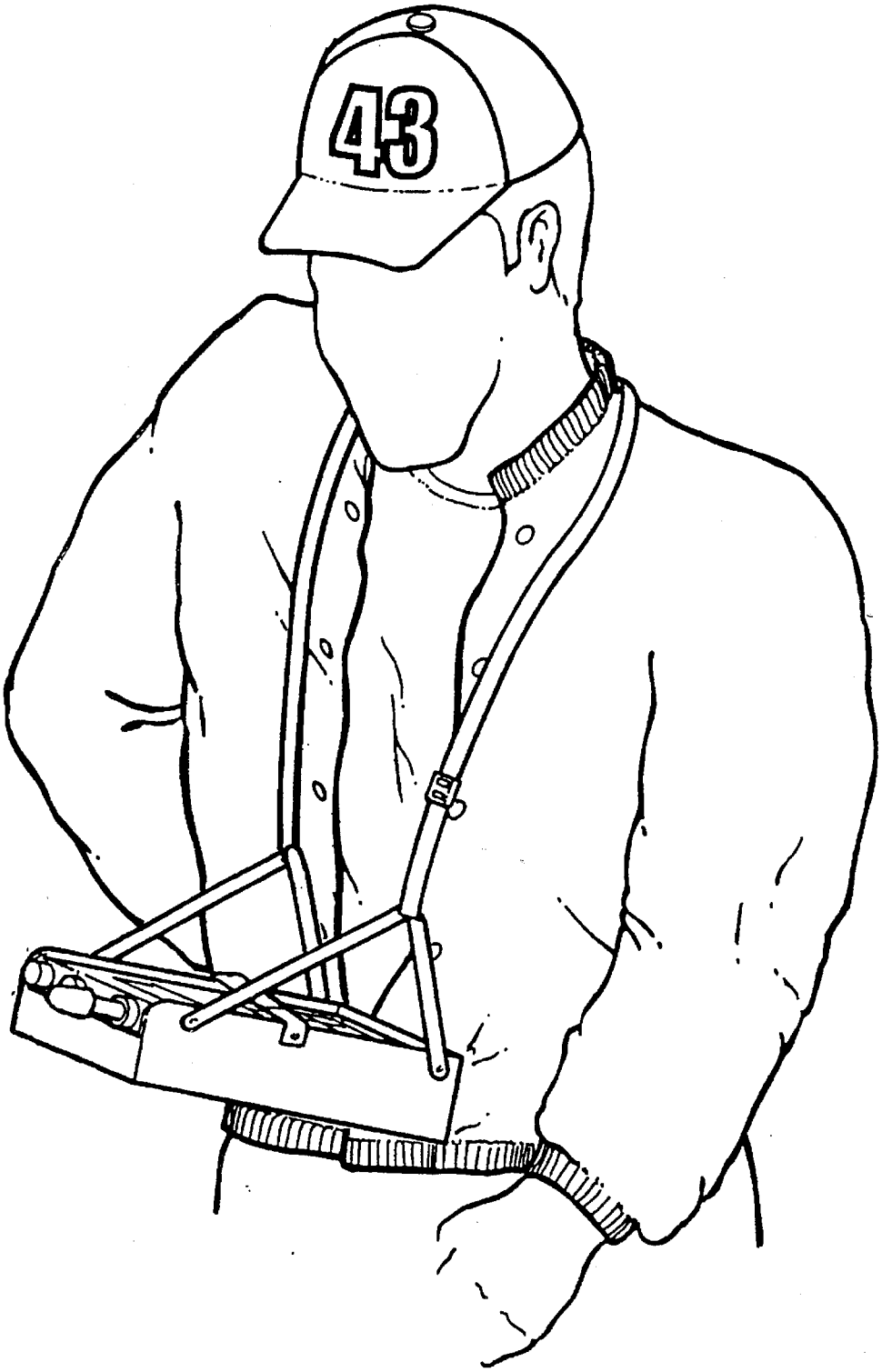
FIG. 1 is an environmental view of the preferred embodiment of the harness of the present invention.
Figure 5:
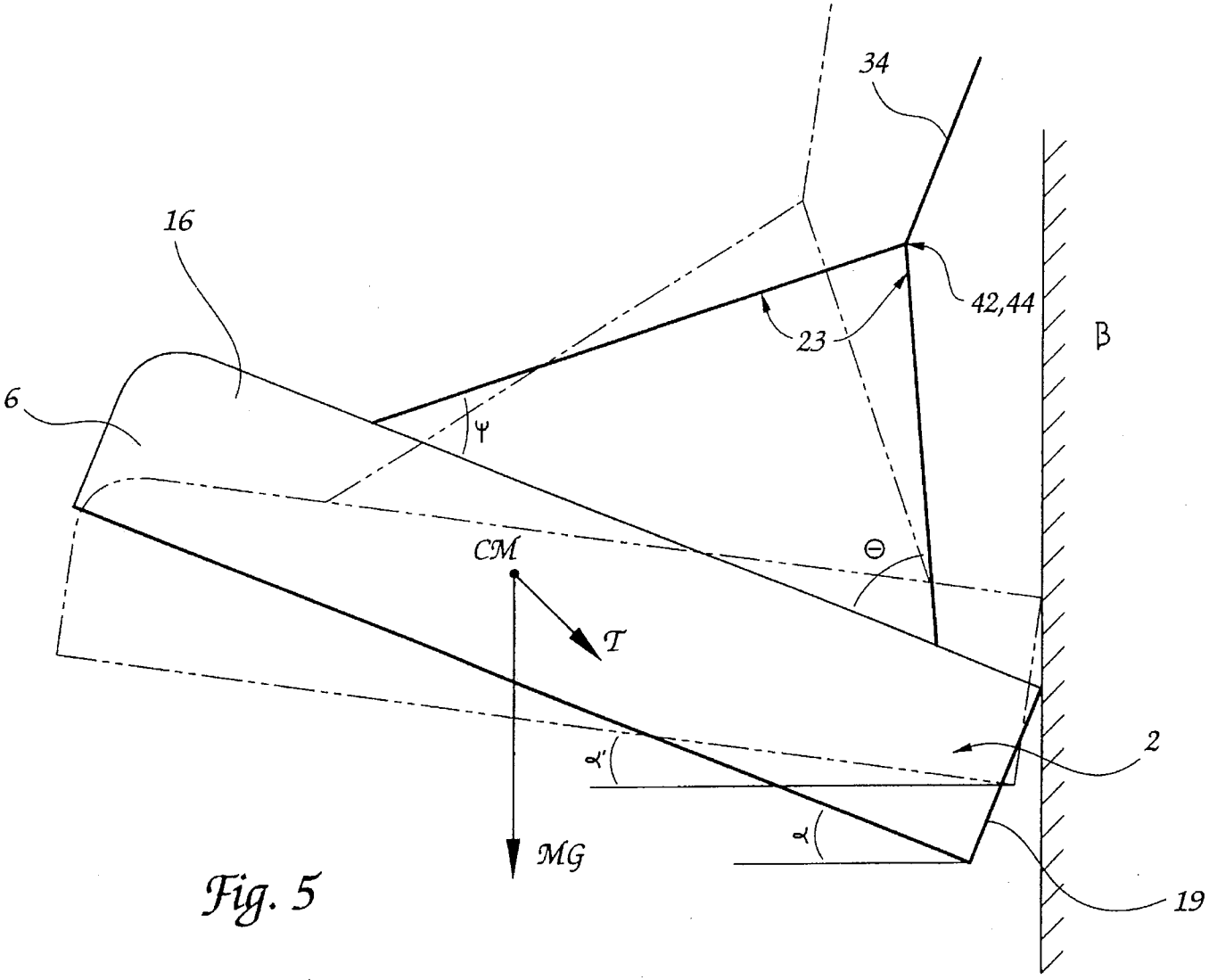
FIG. 5 is a schematic diagram that shows the neck harness of FIG. 1 when a scanner is received therein suspended at two different angles from a user's neck, with one orientation in phantom, and that also shows the gravitational torque that acts on the center of mass of the harness and received scanner when suspended at one orientation.

Operation of neck harness 4 of the present invention is as follows. A scanner or other object to be suspended about the neck of a user is placed within housing 6 and securely fastened by fasteners 8. Neck strap 34 is then placed around the neck of a user with the lower part of housing 6, including lower wall 19, positioned against a user's torso at an upward angle a, as illustrated in FIG. 5. Preferably, the upper edge of lower wall 19 securely engages the torso of the user, as illustrated in FIGS. 1 and 5. When released, neck strap 34 holds housing 6 by way of rigid brace arrangement 23 in place at a slight upward angle $\alpha$ forwardly of the user's torso.

Because of the unique framework of the present invention, i.e., the rigid angular support members, the tension in neck strap 34 in suspending housing 6 containing a scanner is distributed to four areas where the brace members are secured to sides 14, 16 of housing 6. The stress produced by this tension on housing 6 is furthermore distributed by a distance S that is almost as long as the length L of housing 6, as illustrated in FIG. 4. Thus, there is no localized area of intense stress in housing 6, as found in some prior art harnesses.

More importantly, due to the unique brace arrangement 23, angle $\alpha$ and orientation of housing 6 are maintained when a user moves from a sitting position to a standing position, and vice-versa. Furthermore, even if neck strap 34, when used in practice, is incorrectly adjusted to be slightly too long and thus housing 6 suspends at an elevation such that a user's thighs slightly engage housing 6 when the user is in a sitting position and tend to support the area of housing 6 around lower wall 19 to decrease angle $\alpha$ at which housing 6 is oriented, when the user suddenly arises to catch a fast-happening occurrence in a racing event, housing 6 will tend to remain in the angled position that it was in when the user was sitting, and tend not to snap or be jarred into another position. Two of these varying orientations in which housing 6 remains stable are illustrated in FIG. 5. Thus, the harness of the present invention does not exhibit a snapping or jerking motion that the harness disclosed, for example, by Waltzer exhibits. If the thighs slightly readjust angle $\alpha$ of housing 6 towards horizontal to $\alpha'$, housing 6 will not suddenly reorient to its original tilted angle $\alpha$ upon standing, but instead it will remain at its altered angle $\alpha'$.

As fully illustrated in FIG. 5, the harness of the present invention exhibits these unique features because rigid V-shaped support members are disposed so that the center of mass CM of the scanner, housing 6, and rigid brace arrangement 23 is positioned further horizontally away from torso $\beta$ of a user than points of attachment 42,44 of the neck strap 34 with the rigid brace arrangement 23. Since center of mass CM is located further horizontally from torso $\beta$ than points of attachment 42,44, a counterclockwise torque T is produced as a result of the gravitational force MG acting on the center of mass CM. This torque T will tend to urge the lower end of housing 6, including lower wall 19 and its upper edge, into torso $\beta$, thereby causing frictional resistance to rotation of housing 6 and blocking the rotational movement of housing 6 towards the horizontal in the counterclockwise direction. Thus, at any upward angle the harness of the present invention will actively tend to remain in its orientation against the torso during movement of the user.

To actually rotate housing 6 through the horizontal, then housing 6 would have to be moved a distance away from torso $\beta$ so that engageable end 2 of housing 6 would clear torso $\beta$, i.e., the lower part of housing 6 including lower wall 19 that would otherwise rotate into torso $\beta$ needs to clear torso $\beta$. Slight adjustment of angle $\alpha$ by the thighs towards the horizontal only results in new $\alpha'$ and a new stabilized orientation, provided that the center of mass CM remains horizontally further from torso $\beta$ than points of attachment 42,44. This situation in which the housing reorients itself to $\alpha'$ from $\alpha$ is illustrated in FIG. 6 with the phantom illustration being the housing at angle $\alpha'$ and the solid illustration being the housing at orientation $\alpha$.

In other words, if angle $\alpha$ of housing 6 is slightly readjusted, housing 6 will not revert to its original angle $\alpha$ upon standing, since to reach an equilibrium state, the system necessarily must rotate in the opposite direction, and a system naturally tends towards an equilibrium state. An equilibrium state of housing 6, i.e., the position of housing 6 in which there is no gravitational torque, is reached when center of mass CM of housing 6, rigid brace arrangement 23, and the scanner is substantially directly positioned vertical to points of attachment 42,44.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended nor should be construed to limit the present invention or otherwise to exclude any such other embodiments, adaptations, variations, modifications and equivalent arrangements, the present invention being limited only by the claims appended hereto and the equivalents thereof.

I claim:

1. A neck harness for suspending a hand-held scanner about a user's neck for disposition of the scanner at a viewable angle forwardly of the user's torso, comprising:

a housing having a channel accommodating the insertion and removal of a scanner to face upwardly from the channel for viewing of the scanner;

a rigid brace arrangement having two rigid angular support members, each said support member respectively attached to said housing at opposite sides of said channel, each said support member having converging portions projecting upwardly from said housing; and an elongated flaccid neck strap having opposite ends connected respectively, to said converging portions of said support members from the user's neck with one end of said housing engaging the user's torso at an upward incline from the user's torso for easy viewability of the scanner.

2. A neck harness according to claim 1, and further comprising means on said neck strap for adjusting the length of said neck strap for selectively positioning the suspension of said housing and said brace arrangement against a user's torso for stable suspension of the scanner substantially unaffected by movement of the user between standing and sitting positions and all transitional positions therebetween.

3. A neck harness according to claim 1, and further comprising fasteners on said housing for securely fastening the scanner within said channel.

4. A neck harness for suspending a hand-held scanner about a user's neck for disposition of the scanner at a viewable angle forwardly of the user's torso, comprising:

a housing for receiving a scanner, said housing having a channel formed by two side walls, a back wall, and bottom, said channel accommodating the insertion and removal of a scanner, said lip accommodating a projecting antennae and control knobs of a received scanner;

a rigid brace arrangement comprising two pair of elongated and rigid brace members, each said pair of brace members having first ends respectively attached to said side walls of said housing, each said brace member of each said pair having second ends projecting upwardly from said housing, said second ends of said brace members of each said pair securely attached together; and a flaccid neck strap having opposite ends attached respectively to said rigid brace members;

wherein said housing and said rigid brace arrangement cooperate to suspend the said housing hands-free at an upward angle from a user's torso when said housing is suspended about a user's neck for easy viewability of the scanner, said back wall of said housing supportingly engaging the user's torso, and wherein said neck strap suspends said housing and said brace arrangement at an elevation against a user's torso for stable suspension of the scanner substantially unaffected by movement of the user between standing and sitting positions and all transitional positions therebetween.

5. A neck harness according to claim 4, and further comprising means on said neck strap for adjusting the length of said neck strap for selectively positioning the suspension of said housing and said brace arrangement against a user's torso for stable suspension of the scanner substantially unaffected by movement of the user between standing and sitting positions and all transitional positions therebetween.

6. A neck harness according to claim 4, and further comprising fasteners on said housing for securely fastening the scanner within said channel.

7. A neck harness according to claim 4, wherein said side walls of said housing have a length, said upper lip, and said back wall have a width, and wherein said length is substantially greater than said width.

8. A neck harness according to claim 7, wherein each said brace member of each said pair is attached to a respective said side wall of said housing at a spacing from the other said brace member of each respective said pair, said spacing being almost as long as the length of said side walls.

9. A neck harness according to claim 4, wherein said second ends of said brace members of each said pair converge with and are securely attached to one another at their said second ends to thereby form V-shaped support members.

10. A neck strap according to claim 4 and further comprising:

means on said neck strap for adjusting the length of said neck strap for selectively positioning the suspension of said housing and said brace arrangement against a user's torso for unaffected suspension of said housing between standing and sitting positions and all transitional positions therebetween; and fasteners on said side walls of said housing for securely fastening the scanner within said channel;

wherein said side walls of said housing have a length, and said upper lip, and said back wall have a width, said length being substantially greater than said width;

wherein each said brace member of each said pair is attached to a respective said side wall of said housing at a spacing from the other said brace member of each respective said pair, said spacing being almost as long as the length of said side walls; and wherein said second ends of said brace members of each said pair converge with and are securely attached to one another at their said second ends to thereby form V-shaped support members.

11. A neck harness for suspending a hand-held scanner about a users neck, comprising:

a housing for receiving a scanner to be suspended, said housing having a length and an end engageable with a user's torso, said housing defining a lengthwise channel for accommodating the insertion of a scanner;

a rigid brace arrangement having a pair of rigid V-shaped angular support members, each said support member respectively attached to said housing at opposite side walls of said channel and having converging portions projecting upwardly from said housing; and an elongated flaccid neck strap having two opposite ends attached to said rigid brace arrangement, each said end of said strap attached to one of said converging portions at attachment points;

wherein each said V-shaped support member has a predetermined angular orientation relative to said housing for disposing each said converging portion so that, when said neck harness is suspended from a user's neck, said attachment points are horizontally closer to the user's torso than the center of mass of said brace arrangement, said housing, and a received scanner, thereby resulting in a gravitational torque about the attachment points tending to urge said engageable end of said housing upward and into a user's torso for stabilized suspension of said housing at an angle forwardly of the user's torso during movement of the user between standing and sitting positions, and all transitional positions therebetween, and further tending to stabilize suspension of said housing at a different angle forwardly of the user's torso when said housing is shifted to said different angle, said center of mass still positioned further horizontally away from the torso than said attachment points when said housing is oriented at said different angle.

12. A neck harness according to claim 11, wherein said rigid angular support members each comprise two elongated brace members, each said brace member having two ends with a first said end securely attached to a respective side wall of said housing and a second said end projecting upwardly from said housing, said brace members of each said pair converging with and securely attached to one another at their said projecting ends thereby forming said converging portions.

13. A neck harness according to claim 12, wherein each said brace member of each said pair is attached to said housing at a spacing from said other said brace member of each said pair, said spacing approximating the length of said housing.

* * * * *

UNITED STATES PATENT AND TRADEMARK OFFICE
CERTIFICATE OF CORRECTION

PATENT NO. : 5,551,615

DATED : September 3, 1996

INVENTOR(S) : Raymond F. McIntosh

It is certified that error appears in the above-identified patent and that said Letters Patent is hereby corrected as shown below:

Column 1, line 6, delete "users" and insert therefor -- user's --.

Column 1, line 11, delete "are" and insert therefor -- is --.

Column 1, line 23, after "and" insert -- , --.

Column 1, line 30, after "and" insert -- , --.

Column 2, line 8, delete "corresponds" and insert therefor -- corresponding --.

Column 2, line 43, after "and" insert -- , --.

Column 3, line 18, delete "antennae" and insert therefor -- antenna --.

Column 3, line 50, delete "that" and insert therefor -- than --.

Column 4, line 63, delete "antennae" and insert therefor -- antenna --.

Column 5, line 13, after "and" insert -- , --.

Column 5, line 21, delete "preferable" and insert therefor -- preferably --.

Column 5, line 21, delete "angels" and insert therefor -- angles --.

Column 5, line 24, delete "rotably" and insert therefor -- rotatably --.

Column 5, line 34, delete "angle a" and insert therefor -- angle $\alpha$ --.

Column 6, line 38, after "since" insert -- , --.

UNITED STATES PATENT AND TRADEMARK OFFICE
CERTIFICATE OF CORRECTION

PATENT NO. : 5,551,615

DATED : September 3, 1996

INVENTOR(S) : Raymond F. McIntosh

It is certified that error appears in the above-identified patent and that said Letters Patent is hereby corrected as shown below:

Column 7, line 3, after "having a" insert -- top and a bottom and a --; and after "channel" insert -- extending therein and open through said top for --.

Column 7, line 13, after "support members" insert -- whereby the housing is suspended hands-free --.

Column 7, line 14, after "torso" insert -- and whereby the housing is disposed --.

Column 7, line 30, after "scanner" insert -- adapted to engage a user's torso --.

Column 7, lines 31-32, delete "and bottom," and insert therefor -- bottom, and a front wall comprising an upper lip, --.

Column 7, line 34, delete "antennae" and insert therefor -- antenna --.

Column 7, line 45, after "said" insert -- second ends of said --.

Column 8, line 3, after "width," insert -- said bottom has a length and a width --.

Column 8, line 25, delete "and".

Column 8, line 26, after "width," insert -- and said bottom has a length and a width --.

Column 8, line 38, delete "users" and insert therefor -- user's --.

UNITED STATES PATENT AND TRADEMARK OFFICE
CERTIFICATE OF CORRECTION

PATENT NO. : 5,551,615

DATED : September 3, 1996

INVENTOR(S) : Raymond F. McIntosh

It is certified that error appears in the above-identified patent and that said Letters Patent is hereby corrected as shown below:

Column 8, line 39, after "suspended," insert -- disposition of said housing being at a viewable angle forwardly of the user's torso,--.

Signed and Sealed this

Seventeenth Day of June, 1997

*Attest:*

Bruce Lehman

BRUCE LEHMAN

*Attesting Officer*

*Commissioner of Patents and Trademarks*